US005506027A

United States Patent [19]

Sanders et al.

[11] Patent Number: 5,506,027

[45] Date of Patent: Apr. 9, 1996

[54] METAL MATRIX MONOTAPE

[75] Inventors: Stuart A. Sanders, Palm Beach Gardens, Fla.; Penny D. Wooton, Canyon, Calif.; Robert J. Surace, Port St. Lucie, Fla.

[73] Assignee: The United States of America as represented by the Secretary of the Air Force, Washington, D.C.

[21] Appl. No.: 265,080

[22] Filed: Jun. 17, 1994

[51] Int. Cl.[6] ..... B32B 5/12; B32B 15/00; D04H 1/00

[52] U.S. Cl. ..... 428/114; 428/294; 428/378; 428/381; 428/383; 428/902

[58] Field of Search ..... 428/294, 902, 428/114, 378, 381, 383; 156/169, 170, 174

[56] References Cited

U.S. PATENT DOCUMENTS

| | | | |
|---|---|---|---|
| 3,091,561 | 5/1963 | Marzocchi et al. | 428/294 |
| 3,869,335 | 3/1975 | Siefert | 428/294 |
| 3,942,231 | 3/1976 | Whitaker | 29/156.8 B |
| 4,518,625 | 5/1985 | Westfall | 427/37 |
| 4,762,268 | 8/1988 | Doble | 228/186 |
| 4,886,202 | 12/1989 | Ammon | 228/120 |
| 4,943,472 | 7/1990 | Dyksterhouse et al. | 428/294 |

*Primary Examiner*—James D. Withers
*Attorney, Agent, or Firm*—Stanton E. Collier; Thomas C. Stover

[57] ABSTRACT

A method for preparing a metal matrix composite (MMC) monotape from a monofilament, is provided. The monofilament is first coated with a primary coating having metal particles uniformly distributed therein to form a primary monofilament. The primary monofilament is then clad with a secondary coating of a resin binder that does not resolvate the primary coating and thus interrupt the distribution of the metal particles therein, to form a doubly coated monofilament. The doubly coated monofilament is then wound in adjacent coils on a mandrel while the secondary coating is still wet so that the coils are bound together by the secondary coating. The end of the monofilament is then cut on the mandrel and secured to a coil adjacent thereto and the so-wound monofilament is then dried on the mandrel. Then the so-wound secondary monofilament is cut across its coils on the mandrel and removed to obtain the resulting MMC monotape. In another embodiment, two or more of the MMC monotapes can be overlayed and adhered together to form a composite part. The invention thus provides a method for preparing the above monotape in one or more layers and the product resulting from such method.

5 Claims, 1 Drawing Sheet

METAL MATRIX MONOTAPE

STATEMENT OF GOVERNMENT INTEREST

The invention described herein may be manufactured and used by or for the Government for governmental purposes without the payment of any royalty thereon.

BACKGROUND OF THE INVENTION

1. Field of the Invention

This invention relates to a metal matrix monotape, particularly a monotape having metal particles of substantially uniform distribution.

2. The Prior Art

Composite monotapes are used in fabrication of high temperature fiber-reinforced metal alloy composite, for, e.g. lightweight aircraft parts. In such process, monotapes using, e.g. tungsten alloy fibers have been prepared. Alternatively, other metal alloy fibers or ceramic fibers have been thus employed.

The selected fiber once made, is then coated, e.g. with a resin binder solution containing metal particles which solution forms a coating around the monofiber or filament. The so-coated filament is then wound on a drum of closely spaced coils and then in some cases, coated with a secondary resin binder solution, the solvent of which however dissolves or resolvates the primary coating, which interrupts the distribution of metal particles in such primary coating and can result in spallation of such coating.

In other prior art such as U.S. Pat. No. 4,518,625 to Westfall (1985), the bare filament is wound on a mandrel in closely spaced coils and has but one coating, a metal spray applied thereto. This avoids the above resolvating problem and avoids interruption of the distribution of metal particles in such single coating. However, lacking a reinforcing flexible second coating means that again, such coating tends to be rigid. Then when the monofilament tape is cut off the mandrel for use in composite parts, such rigidity makes it unsuitable for complex geometry lay-ups.

Accordingly there is need and market for a method for producing a flexible metal matrix composite (MMC) monotape that substantially overcomes the above prior art shortcomings.

There has now been discovered a method for manufacturing a flexible matrix composite monotape in which the distribution of metal particles in the primary coating is substantially uniform rather than interrupted, to form a flexible monotape that is suitable for making high strength parts of complex geometry and the composite monotape produced by such method.

SUMMARY OF THE INVENTION

Broadly the present invention provides a method for preparing a metal matrix composite (MMC) monotape from a monofilament. The monofilament is clad with a primary coating of a resin binder that has metal particles substantially uniformly dispersed therein to form a primary coated monofilament. The primary coated monofilament is then clad with a secondary coating of a resin binder in a solvent that does not solvate the primary coating, to form a doubly coated monofilament;

The doubly coated monofilament is then wound onto a mandrel in closely spaced coils to bind the coils together by the secondary coating. Then the incoming monofilament is cut from from its source and the resulting cut end is secured to one or more of the coils. The so wound monofilament is then dried on the mandrel. One then cuts across the coils of the so-wound monofilament and removes the monofilaments from the mandrel to obtain such composite monotape.

The invention further provides a metal matrix composite (MMC) monotape from the above method. Such monotape has closely spaced monofilaments in side-by-side array. Each monofilament has a primary coating around each of the monofilaments to define primary coated monofilaments. The primary coating has a resin binder that has metal particles substantially uniformly dispersed therein. Also there is a secondary coating of a resin binder around the primary coated monofilaments which binds them together.

BRIEF DESCRIPTION OF THE DRAWINGS

The invention will become more apparent from the following detailed, specification and drawings in which.

DETAILED DESCRIPTION OF THE PREFERRED EMBODIMENTS

Figure 1:
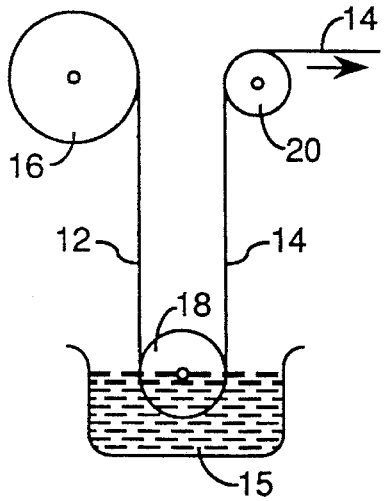
FIG. 1 is a schematic elevation fragmentary view of a method of preparing a monofilament embodying the present invention.
Figure 2:
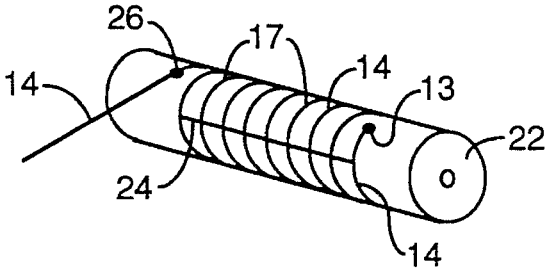
FIG. 2 is a perspective schematic fragmentary view of a portion of the method shown in FIG. 1

Referring in more detail to the drawings, monofilament 10 having a primary coating 12, is fed from supply roller 16 into bath 15, around roller 18, from which bath 15 a monofilament emerges, coated with a secondary coating 14 and passes around idler roller 20 on the way to wind-up, as shown or indicated in FIGS. 1 and 2.

Figure 3:
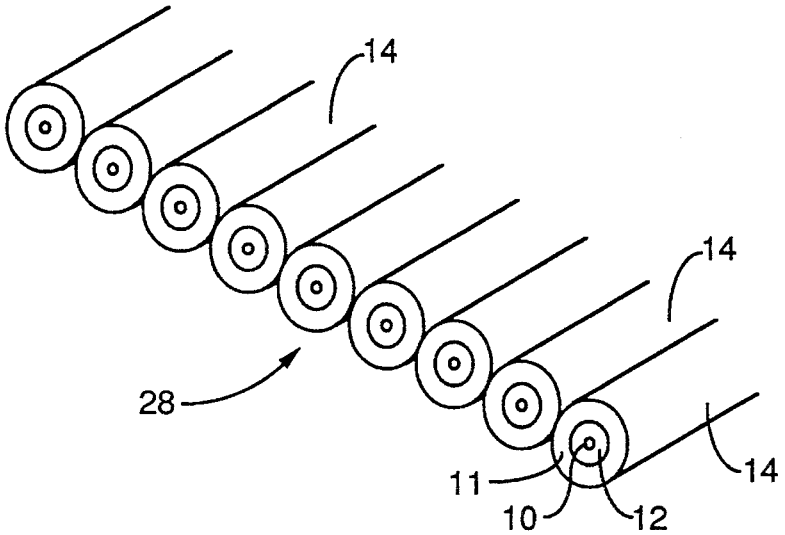
FIG. 3 is a perspective fragmentary view of a product prepared according to the method of the invention shown in FIGS. 1 and 2.

The doubly coated filament 14 then passes to wind-up mandrel 22 where it is wound in closely spaced coils 17, as shown or indicated in FIGS. 2 and 3.

The incoming filament is cut e.g. at point 25 and ends 26 and 13 of the winding are secured in place by adhesion to an adjacent coil 17, of the so wound filament 14, as shown or indicated in FIG. 2. The so wound filament 14 is then dried on the mandrel 22, e.g. by application of hot air thereto (by means not shown).

The so wound filament 14 is then cut across the coils 17 as indicated by cut line 24 and the winding so cut, is removed as a monofilament layer 28, as shown in FIG. 3. Each doubly coated filament 14 is adhered to and uniformly spaced from its neighbor by the so-dried secondary coating 14, as shown or indicated in FIG. 3.

Thus the present invention provides a method for constructing a coherent, flexible metal matrix composite (MMC) monotape as well as the MMC monotape product prepared thereby.

The so-formed monotape can be very flexible and lends itself to easily laying up and fabricating MMC components of simple or complex geometry.

Other advantages of the method of the invention include: 1) low toxicity, 2) no odor, 3) low residue (critical in minimizing interstitial contamination of MMC parts during processing), 4) low cost, 5) thermoplasticity/water solubility (allows pre-forming of plies as well as "tacking" of adjacent plies, to hold the lay-up together; either may be accomplished by heating or steaming plies in local areas to soften the secondary coating or binder) and 6) non-disruptiveness to powder-coated monofilaments, i.e. leaves matrix powder coating substantially uniform or non interrupted. This is important when powder metallurgy techniques are employed in MMC fabrication.

Thus the improved method of the invention provides the application of, e.g. an aqueous polyvinyl alcohol (PVA) coating on bare or powder-coated monofilaments, which are wound onto a mandrel with preferably uniform fiber spacing. Upon drying, e.g. under a heat gun, the PVA coating forms a coherent, pliable film which not only holds the filaments together, but preserves the uniformity of fiber spacing therebetween as indicated above. The resulting flexible monotape can then be cut from the mandrel and stored as needed.

The core monofilamentcan be of a Carbon base or other fiber, e.g. of Boron, Tungsten and preferably of SiC.

The primary coating is a metal matrix coating, e.g. a resin binder having substantially uniformly dispersed metal particles therein such as of Aluminum, Copper, Beryllium and preferably Titanium. Such resin binder can be, e.g. polymethylmethacrylate (PMMA): Polyvinyl isobutylene (PIB) or polyvinyl isobutyl ether (PVI); dissolved in organic solvent.

The secondary coating is one whose solvent does not resolvate the primary coating and one which readily adheres to adjacent coils of itself and one which dries to form a durable and flexible outer filament or monotape coating. Such secondary coating depends on the binder chosen for the primary coating. In general, the primary binder should be soluble in organic solvents and the secondary binder should be soluble in water or vice-versa. A preferred secondary coating herein is of PVA.

This is because upon cutting the monotape from the mandrel, e.g. as indicated in FIGS. 2 and 3 above, with an incorrect secondary filament coating, such monotape will tend to curl. However, a monotape fabricated with PVA as the secondary coating does not so curl and upon application of water thereto, becomes tacky to permit the bonding of successive plies of such monotape together, upon drying of the contact points thereof.

Accordingly the above method of the invention is believed novel in the fabrication of MMC monotapes because it provides ease of handling and fabrication of individual plies, permits traditional lay-up techniques to be used for durable parts of both simple and complex geometries.

The resulting monotape and plies thereof are believed to be of novel structure as noted above.

The MMC monotape of the invention can be used to fabricate various lightweight durable structures, such as fan blades for commercial airlines, rotating components for aircraft, lightweight storage tanks, automobile structures and components thereof, parts of piston engines, airframe structures for aircraft, and numerous other lightweight durable structural components.

What is claimed is:

1. A metal matrix composite (MMC) monotape comprising:

a) closely spaced monofilaments in side-by-side array, b) a primary coating of a substantially uniform and uninterrupted distribution of metal particles in a resin binder, which primary coating is around each of said monofilaments to define primary coated monofilaments and c) a secondary coating of a resin binder around said primary coated monofilaments which binds them together, wherein the secondary coating does not resolvate the primary coating.

2. The monotape of claim 1 wherein said filament is of material selected from the group consisting of Carbon, Boron, Tungsten and SiC.

3. The monotape of claim 1 wherein said metal particles are selected from the group consisting of Aluminum, Copper, Beryllium and Titanium.

4. The monofilament of claim 1 wherein said secondary coating comprises PVA.

5. The monotape of claim 1 being positioned between at least a pair of other monotapes and adhered thereto to form an MMC part.

* * * * *